US010662802B2

(12) United States Patent
Haller

(10) Patent No.: US 10,662,802 B2
(45) Date of Patent: May 26, 2020

(54) CONTROLLED FLOW GUIDES FOR TURBINES

(71) Applicant: General Electric Company, Schenectady, NY (US)

(72) Inventor: Brian Robert Haller, Rugby (GB)

(73) Assignee: General Electric Company, Schenectady, NY (US)

( * ) Notice: Subject to any disclaimer, the term of this patent is extended or adjusted under 35 U.S.C. 154(b) by 117 days.

(21) Appl. No.: 15/859,823

(22) Filed: Jan. 2, 2018

(65) Prior Publication Data

US 2019/0203609 A1 Jul. 4, 2019

(51) Int. Cl.
*F01D 17/16* (2006.01)
*F01D 1/02* (2006.01)

(52) U.S. Cl.
CPC ..... *F01D 17/16* (2013.01); *F01D 1/026* (2013.01); *F05D 2220/31* (2013.01)

(58) Field of Classification Search
CPC . F01D 5/06; F01D 5/143; F01D 5/145; F01D 5/147; F01D 9/041; F01D 17/16; F05D 220/31; F05D 2220/31
See application file for complete search history.

(56) References Cited

U.S. PATENT DOCUMENTS

| | | | |
|---|---|---|---|
| 2011/0123313 | A1 | 5/2011 | Blatchford et al. |
| 2012/0027568 | A1 | 2/2012 | Haller |
| 2012/0183411 | A1 | 7/2012 | Haller |
| 2012/0189441 | A1 | 7/2012 | Haller et al. |
| 2014/0369815 | A1 | 12/2014 | Haller et al. |
| 2016/0146013 | A1 | 5/2016 | Haller |
| 2016/0230573 | A1 | 8/2016 | Haller |

OTHER PUBLICATIONS

International Search Report for PCT/US20181063072, dated Mar. 21, 2019 (4 pp.).
Written Opinion for PCT/US2018/063072, dated Mar. 21, 2019 (6 pp.).

*Primary Examiner* — Richard A Edgar
*Assistant Examiner* — Maxime M Adjagbe
(74) *Attorney, Agent, or Firm* — Eversheds Sutherland (US) LLP

(57) ABSTRACT

This application provides a steam turbine. The steam turbine may include a number of controlled flow runners and a number of controlled flow guides. The controlled flow guides may include an upstream passage ratio ($W_{up}/W$) of 0.4 to 0.7.

15 Claims, 5 Drawing Sheets

CONTROLLED FLOW GUIDES FOR TURBINES

TECHNICAL FIELD

The present application and the resultant patent relate generally to axial flow turbines of any type and more particularly relate to controlled flow guides for steam turbines such as Controlled Flow 2 Next Generation (CF2NG) guides.

BACKGROUND OF THE INVENTION

Generally described, steam turbines and the like may have a defined steam path that includes a steam inlet, a turbine section, and a steam outlet. Steam leakage, either out of the steam path, or into the steam path from an area of higher pressure to an area of lower pressure, may adversely affect the operating efficiency of the steam turbine. For example, steam path leakage in the steam turbine between a rotating shaft and a circumferentially surrounding turbine casing may lower the overall efficiency of the steam turbine.

Steam generally may flow through a number of turbine stages typically disposed in series through first-stage blades such as guides and runners (or nozzles and buckets) and subsequently through guides and runners of later stages of the turbine. In this manner, the guides may direct the steam toward the respective runners, causing the runners to rotate and drive a load, such as an electrical generator and the like. The steam may be contained by circumferential shrouds surrounding the runners, which also may aid in directing the steam or combustion gases along the path. In this manner, the turbine guides, runners, and shrouds may be subjected to high temperatures resulting from the steam, which may result in the formation of hot spots and high thermal stresses in these components. Because the efficiency of a steam turbine is dependent on its operating temperatures, there is an ongoing demand for components positioned along the steam or hot gas path to be capable of withstanding increasingly higher temperatures without failure or decrease in useful life.

Certain turbine blades may be formed with an airfoil geometry. The blades may be attached to tips and roots, where the roots are used to couple a blade to a disc or drum. The turbine blade geometry and dimensions may result in certain profile losses, secondary losses, leakage losses, mixing losses, and the like that may adversely affect efficiency and/or performance of a steam turbine.

In some cases, e.g., steam delivery on the saturation line from a Pressurized Water Reactor, the turbine may operate with wet steam flows. Such flows may create additional wetness losses via the non-equilibrium expansion of the steam (which generates fine fog) and consequential coarse water losses.

SUMMARY OF THE INVENTION

The present application and the resultant patent thus provide a steam turbine. The steam turbine may include a number of controlled flow runners and a number of controlled flow guides. The controlled flow guides may include an upstream passage ratio ($W_{up}/W$) of 0.4 to 0.7.

These and other features and improvements of this application and the resultant patent will become apparent to one of ordinary skill in the art upon review of the following detailed description when taken in conjunction with the several drawings and the appended claims.

DETAILED DESCRIPTION

Figure 1:
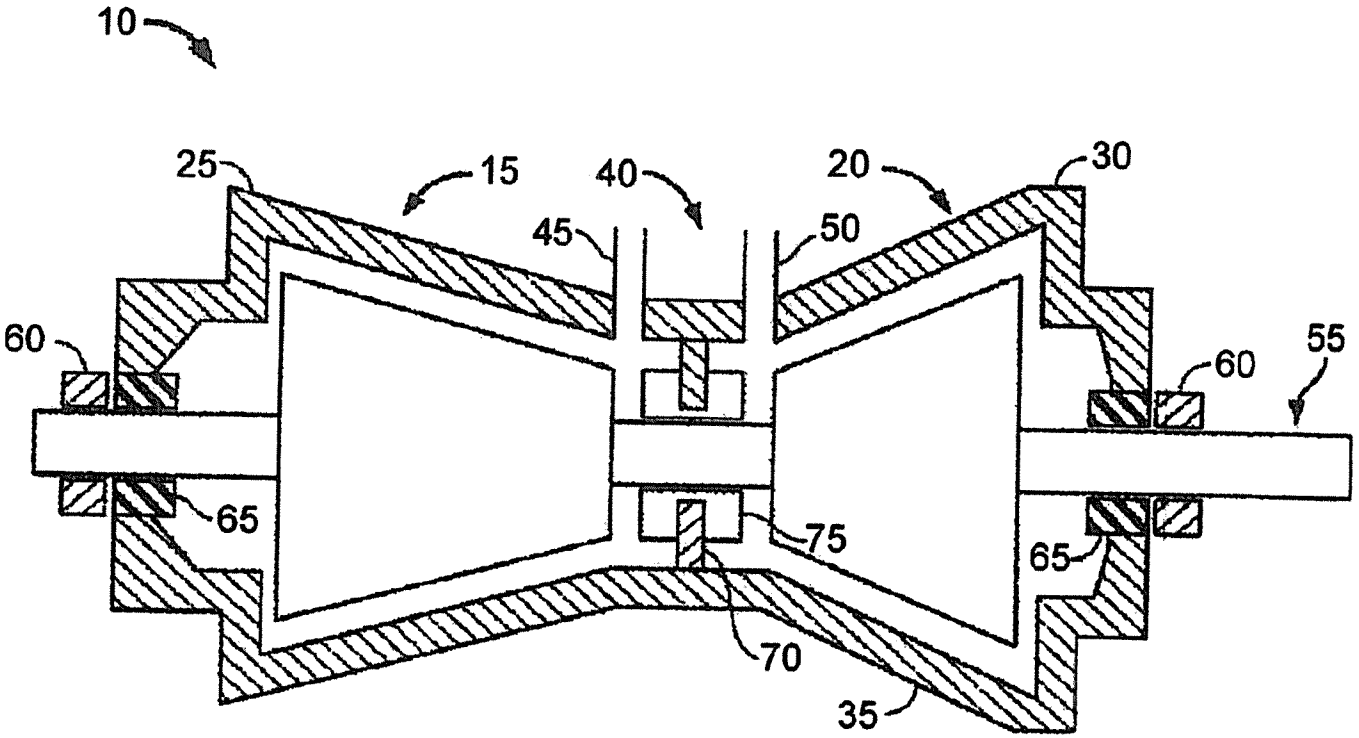
FIG. 1 is a schematic diagram of a steam turbine.

Referring now to the drawings, in which like numerals refer to like elements throughout the several views, FIG. 1 shows a schematic diagram of an example of a steam turbine 10. Generally described, the steam turbine 10 may include a high pressure section 15 and an intermediate pressure section 20. Other pressures in other sections also may be used herein. An outer shell or casing 25 may be divided axially into an upper half section 30 and a lower half section 35. A central section 40 of the casing 25 may include a high pressure steam inlet 45 and an intermediate pressure steam inlet 50. Within the casing 25, the high pressure section 15 and the intermediate pressure section 20 may be arranged about a rotor or disc 55. The disc 55 may be supported by a number of bearings 60. A steam seal unit 65 may be located inboard of each of the bearings 60. An annular section divider 70 may extend radially inward from the central section 40 towards the disc. The divider 70 may include a number of packing casings 75. Other components and other configurations may be used.

During operation, the high pressure steam inlet 45 receives high pressure steam from a steam source. The steam may be routed through the high pressure section 15 such that work is extracted from the steam by rotation of the disc 55. The steam exits the high pressure section 15 and then may be returned to the steam source for reheating. The reheated steam then may be rerouted to the intermediate pressure section inlet 50. The steam may be returned to the intermediate pressure section 20 at a reduced pressure as compared to the steam entering the high pressure section 15 but at a temperature that is approximately equal to the temperature of the steam entering the high pressure section 15. Accordingly, an operating pressure within the high pressure section 15 may be higher than an operating pressure within the intermediary section 20 such that the steam within the high pressure section 15 tends to flow towards the intermediate section 20 through leakage paths that may develop between the high pressure 15 and the intermediate pressure section 20. One such leakage path may extend through the packing casing 75 about the disc shaft 55. Other leaks may develop across the steam seal unit 65 and elsewhere.

Figure 2:
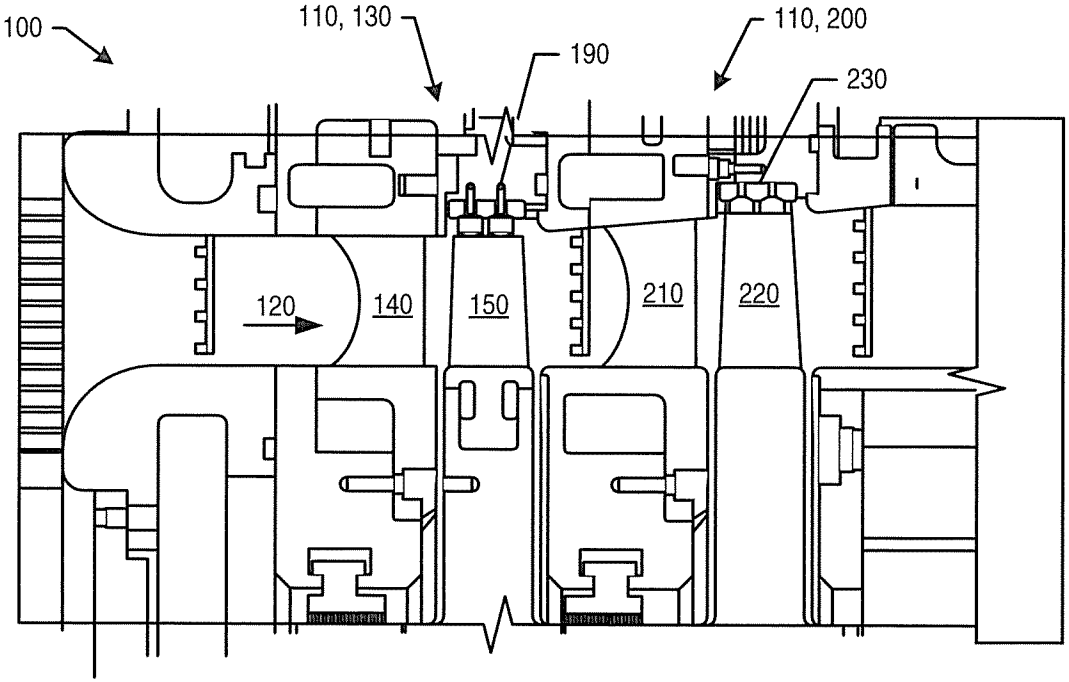
FIG. 2 is a schematic diagram of a portion of a steam turbine showing a number of turbine stages.
Figure 3:
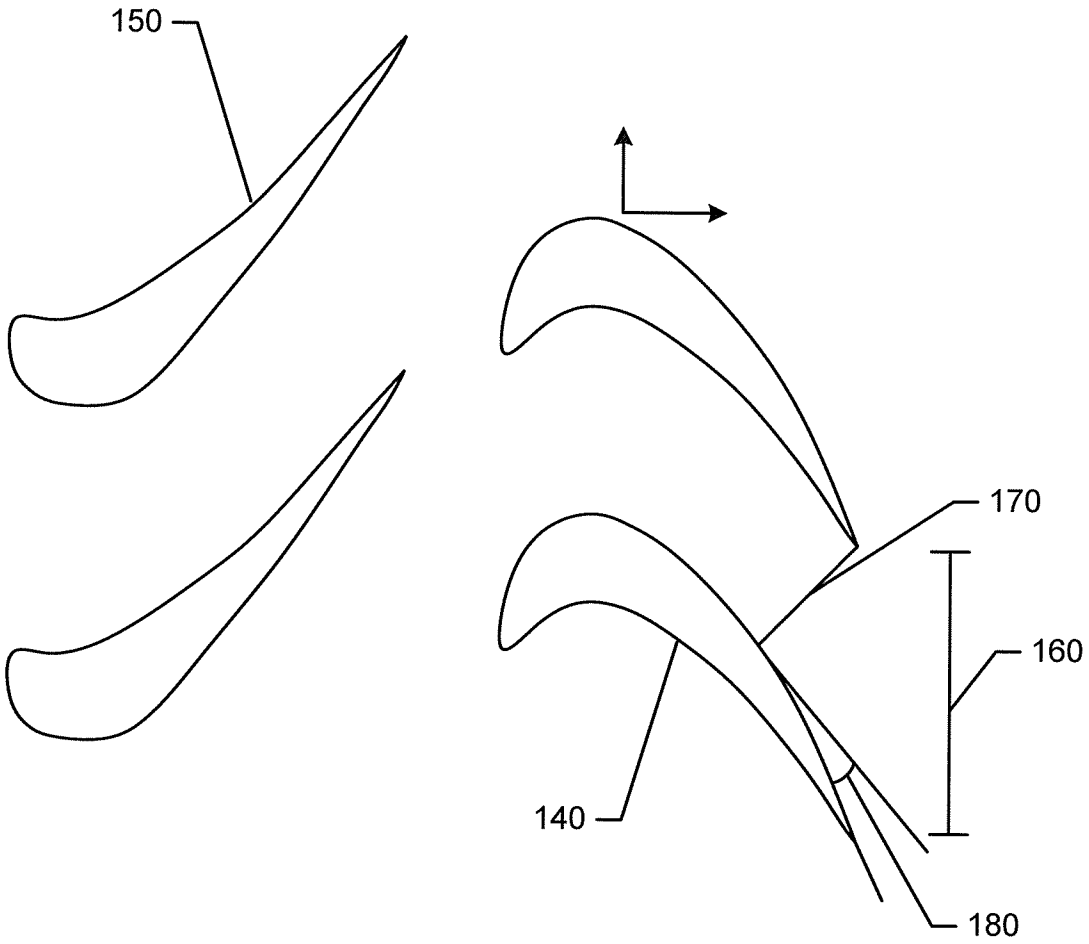
FIG. 3 is a plan view of a number of controlled flow guides and controlled flow runners that may be used in the steam turbine of FIG. 2.

FIGS. 2 and 3 show a schematic diagram of a portion of the steam turbine 100 including a number of stages 110 positioned in a steam or hot gas path 120. A first stage 130 may include a number of circumferentially-spaced first-stage controlled flow guides 140 and a number of circumferentially-spaced first-stage controlled flow runners 150. The controlled flow guides 140 and the controlled flow runners 150 may have a pitch 160, a throat 170, and a back surface deflection angle 180, wherein the pitch 160 is defined as the distance in the circumferential direction between corresponding points on adjacent guides 140 and adjacent runners 150, the throat 170 is defined as the shortest distance between surfaces of adjacent guides 140 and adjacent runners 150, and the back surface deflection angle (BSD) 180 is defined as the "uncovered turning", that is the change in angle between suction surface throat point and suction surface trailing edge blend point.

The first stage 130 may include a first-stage shroud 190 extending circumferentially and surrounding the first-stage controlled flow runners 150. The first-stage shroud 190 may include a number of shroud segments positioned adjacent one another in an annular arrangement. In a similar manner, a second stage 200 may include a number of second-stage controlled flow guides 210, a number of second-stage controlled flow runners 220, and a second-stage shroud 230 surrounding the second-stage controlled flow runners 220. The controlled flow guides 140 may have an Impulse Technology Blading (ITB) guide design. The controlled flow guides 140 may be original equipment or a retrofit. Any number of stages and corresponding guides and runners may be included. Other embodiments may have different configurations.

Figure 4:
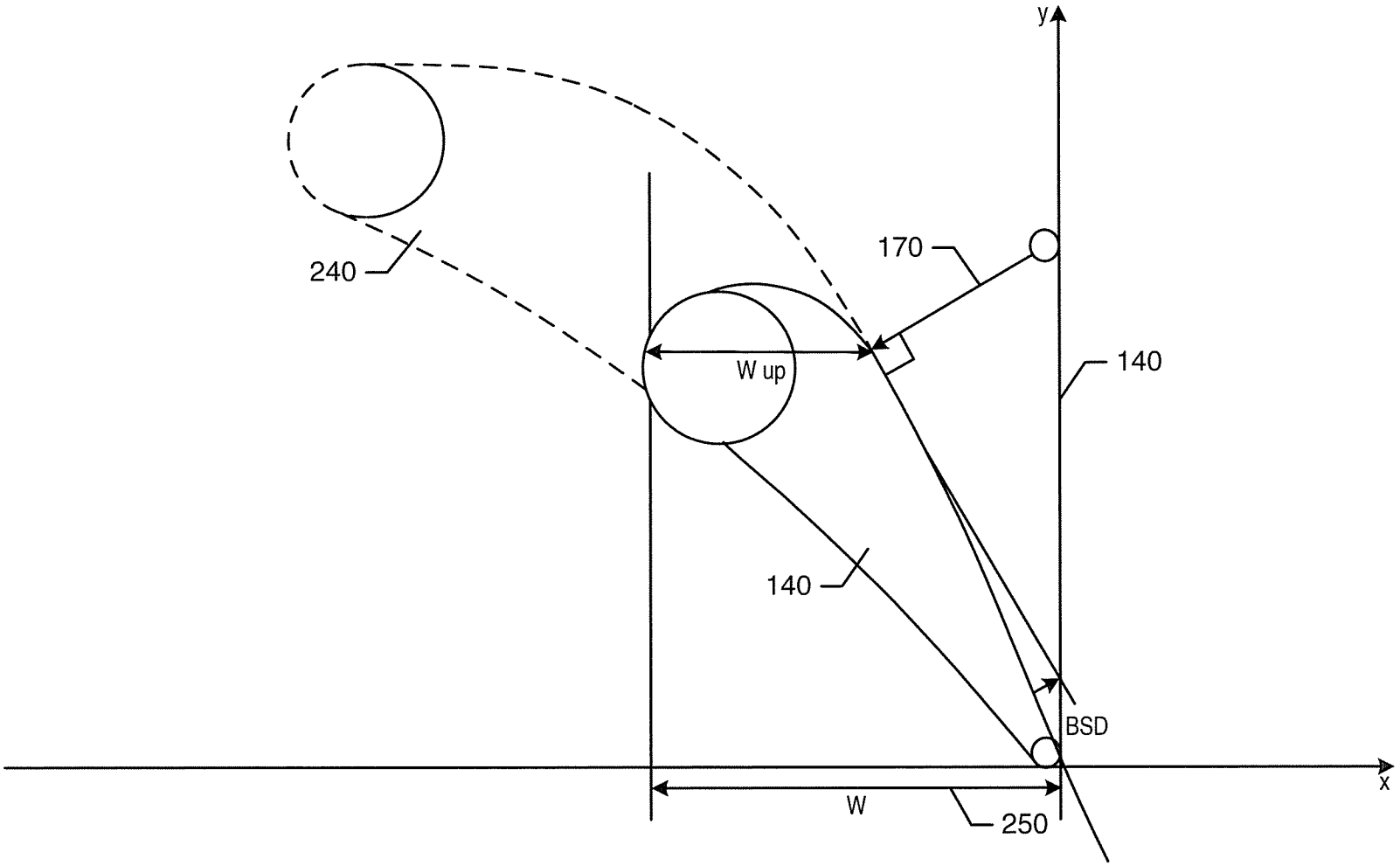
FIG. 4 is a plan view of a number of controlled flow guides as described herein and compared to a known controlled flow guide.

Referring to FIG. 4, a controlled flow guide 140 as may be described herein is shown with a known guide 240 superimposed thereon in dashed lines for a comparison therewith. As can be seen, the controlled flow guides 140 may have a very high pitch to width ratio given a width reduction of more than about thirty percent or so as compared to the known guide 240. The area reduction may run from about 25 percent to about 50 percent or so. The pitch to width ratio may be more than about 1.9 or so. Such a ratio may reduce overall profile losses. The back surface deflection angle 180 may be more than about 25 degrees to about 38 degrees or so with about 30 degrees preferred. The high forward leading edge sweep off-loads the endwall sections and reduces secondary flow and losses. The upstream passage ratio ($W_{up}/W$) 250 may be relatively short in the range of about 0.4 to 0.7 or so with about 0.6 preferred.

Figure 5:
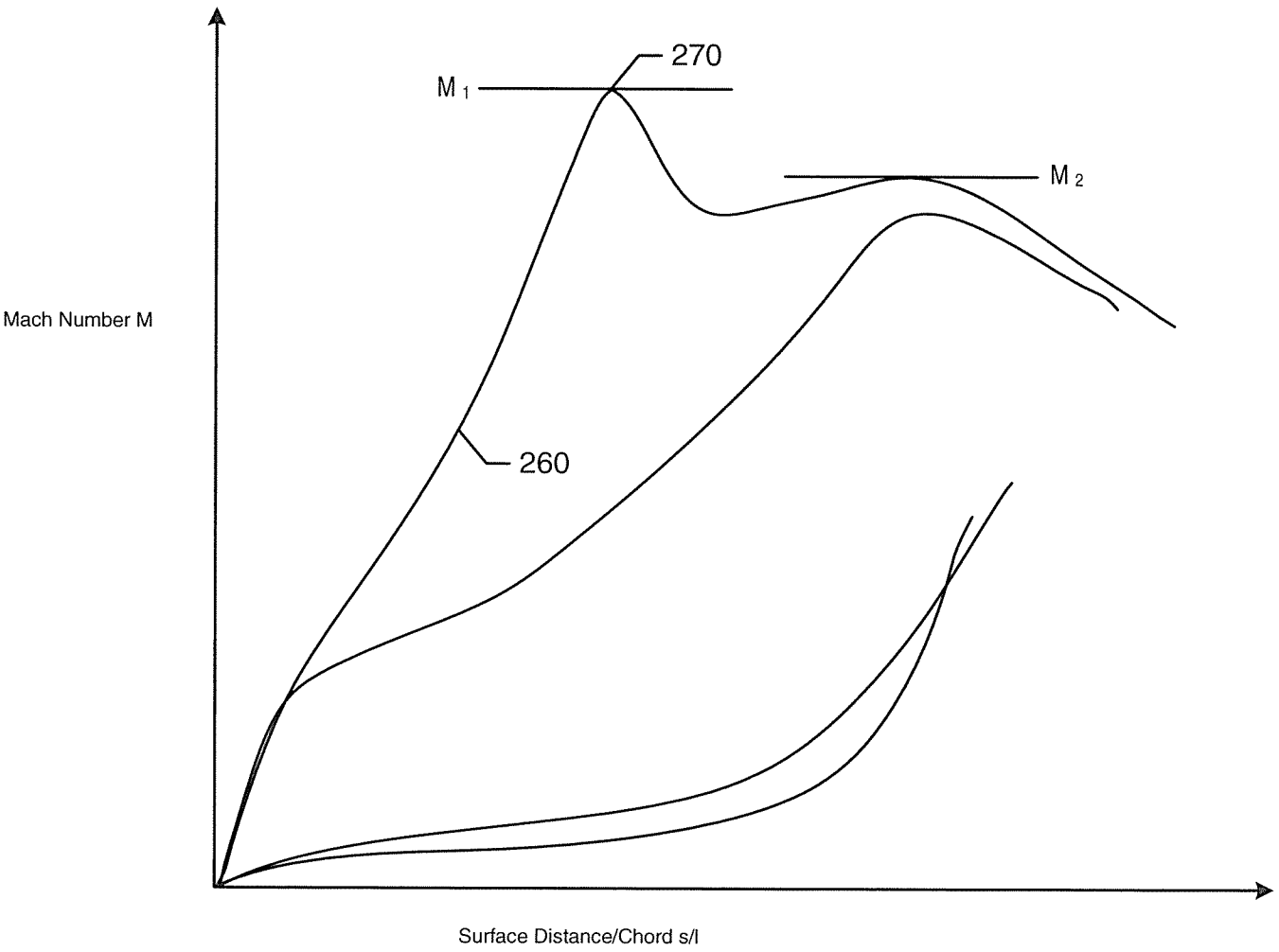
FIG. 5 is a chart showing Mach number distributions.

The design provides a very high suction side acceleration rate. As is shown in FIG. 5, a suction side acceleration rate (dp/ds) 260 may be in the range of −0.05 to −0.25 bar/mm or so with about −0.2 bar/mm preferred. The suction side acceleration 260 may have a surprising, non-intuitive upstream "bump" 270 in the Mach number distribution ($M_1/M_2$) upstream of the throat 170, with the distribution in the range of about 1.01 to about 1.2 or so with about 1.07 preferred.

This very high initial acceleration on the suction surface thus gives smaller droplet sizes, reduced thermodynamic wetness losses, and reduced consequential wetness losses. The gain in dry stage efficiency may be about 0.2% and wetness losses may be reduced by about 20% as compared to conventional designs. The overall design may safely approach or even somewhat exceed a conventional boundary layer shape factor and the like.

It should be apparent that the foregoing relates only to certain embodiments of this application and resultant patent. Numerous changes and modifications may be made herein by one of ordinary skill in the art without departing from the general spirit and scope of the invention as defined by the following claims and the equivalents thereof.

I claim:

1. A steam turbine, comprising:

a plurality of controlled flow runners; and a plurality of controlled flow guides;

the plurality of controlled flow guides defines an upstream passage ratio ($W_{up}/W$) of 0.4 to 0.7.

2. The steam turbine of claim 1, wherein the upstream passage ratio ($W_{up}/W$) is 0.6.

3. The steam turbine of claim 1, wherein the plurality of controlled flow guides comprises a pitch to width ratio of more than 1.9.

4. The steam turbine of claim 1, wherein the plurality of controlled flow guides comprises a suction side acceleration rate of −0.05 to −0.25 bar/mm.

5. The steam turbine of claim 1, wherein the plurality of controlled flow guides comprises a suction side acceleration rate of −0.2 bar/mm.

6. The steam turbine of claim 1, wherein each respective pair of the plurality of controlled flow guides comprises a throat therebetween.

7. The steam turbine of claim 6, wherein each respective pair of the plurality of controlled flow guides comprises a Mach number distribution ($M_1/M_2$) upstream of the throat of more than 1.01.

8. The steam turbine of claim 6, wherein each respective pair of the plurality of controlled flow guides comprises a Mach number distribution upstream ($M_1/M_2$) of the throat of 1.07.

9. The steam turbine of claim 1, wherein the plurality of controlled flow guides comprises a deflection angle of between 25 degrees to 38 degrees.

10. The steam turbine of claim 1, wherein the plurality of controlled flow guides comprises a deflection angle of 30 degrees.

11. The steam turbine of claim 1, wherein the plurality of controlled flow guides is attached to a casing.

12. The steam turbine of claim 1, wherein the plurality of controlled flow guides comprises a plurality of first stage controlled flow guides.

13. The steam turbine of claim 1, wherein the plurality of controlled flow guides comprises a plurality of second stage controlled flow guides.

14. The steam turbine of claim 1, wherein the plurality of controlled flow guides comprises a retrofit.

15. The steam turbine of claim 1, wherein the plurality of controlled flow runners is attached to a disc.

* * * * *